US009409743B2

(12) United States Patent
Arimura

(10) Patent No.: US 9,409,743 B2
(45) Date of Patent: Aug. 9, 2016

(54) SHEET EJECTING DEVICE AND IMAGE FORMING APPARATUS

(71) Applicant: KYOCERA Document Solutions Inc., Osaka-shi (JP)

(72) Inventor: Shingo Arimura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/750,687

(22) Filed: Jun. 25, 2015

(65) Prior Publication Data

US 2015/0375956 A1 Dec. 31, 2015

(30) Foreign Application Priority Data

Jun. 26, 2014 (JP) ..... 2014-131533

(51) Int. Cl.

| | |
|---|---|
| ***B65H 7/02*** | (2006.01) |
| ***B65H 29/14*** | (2006.01) |
| ***B65H 43/08*** | (2006.01) |
| ***B65H 29/12*** | (2006.01) |
| ***B65H 43/02*** | (2006.01) |
| ***B65H 29/52*** | (2006.01) |
| ***B65H 29/70*** | (2006.01) |

(52) U.S. Cl.

CPC ..... *B65H 43/08* (2013.01); *B65H 7/02* (2013.01); *B65H 29/125* (2013.01); *B65H 29/14* (2013.01); *B65H 29/52* (2013.01); *B65H 29/70* (2013.01); *B65H 43/02* (2013.01); *B65H 2404/612* (2013.01); *B65H 2404/64* (2013.01); *B65H 2511/528* (2013.01); *B65H 2513/53* (2013.01); *B65H 2553/612* (2013.01); *B65H 2801/06* (2013.01)

(58) Field of Classification Search

CPC ..... B65H 7/02; B65H 7/14; B65H 43/08; B65H 29/12; B65H 29/125; B65H 29/20; B65H 29/22; B65H 5/36; B65H 29/14

See application file for complete search history.

(56) References Cited

U.S. PATENT DOCUMENTS

| | | | | | |
|---|---|---|---|---|---|
| 5,963,754 | A * | 10/1999 | Itoh | B65H 29/14 | 271/258.01 |
| 6,295,081 | B1 * | 9/2001 | Kashima | B65H 39/11 | 271/290 |
| 6,443,449 | B1 * | 9/2002 | Takagi | B65H 31/22 | 271/279 |
| 7,532,854 | B2 * | 5/2009 | Shin | B65H 29/14 | 399/405 |

FOREIGN PATENT DOCUMENTS

| | | | |
|---|---|---|---|
| JP | 10186738 | A * | 7/1998 |
| JP | 2003-192225 | A | 7/2003 |
| JP | 2006008271 | A * | 1/2006 |

* cited by examiner

*Primary Examiner* — Luis A Gonzalez

(74) *Attorney, Agent, or Firm* — Studebaker & Brackett PC

(57) ABSTRACT

A sheet ejecting device includes a sheet conveyance path, an exit port, at least one ejection roller pair, and a sheet detection portion. The sheet detection portion detects a sheet being ejected. The sheet detection portion includes an actuator and a sensor. The actuator moves by contact with a sheet passing along the sheet conveyance path. The sensor detects the actuator. The actuator moves between a detectable position where the actuator is detectable by the sensor and an undetectable position where the actuator is not detectable by the sensor. The actuator has a sheet guide portion. The sheet guide portion extends along a sheet conveyance direction. The sheet guide portion moves, in a direction transverse to the sheet conveyance direction such that the actuator moves to the detectable position, by contact with the sheet passing along the sheet conveyance path and guides the sheet in the sheet conveyance direction.

6 Claims, 6 Drawing Sheets

SHEET EJECTING DEVICE AND IMAGE FORMING APPARATUS

INCORPORATION BY REFERENCE

The present application claims priority under 35 U.S.C. §119 to Japanese Patent Application No. 2014-131533, filed Jun. 26, 2014. The contents of this application are incorporated herein by reference in their entirety.

BACKGROUND

The present disclosure relates to a sheet ejecting device and an image forming apparatus.

A sheet ejecting device in an image forming apparatus has an actuator (sheet detection mechanism) at a sheet exit port for detecting a sheet load or the presence or absence of a sheet jam. In an image forming apparatus, a photointerrupter detects a jam or fullness of an exit tray by turning of a filler.

SUMMARY

A sheet ejecting device according to the present disclosure ejects a sheet conveyed thereto. The sheet ejecting device includes a sheet conveyance path, an exit port, at least one ejection roller pair, and a sheet detection portion. The sheet is conveyed along the sheet conveyance path. The sheet is ejected from the exit port. The ejection roller pair is disposed at the exit port. The ejection roller pair includes a drive roller and a driven roller. The drive roller and the driven roller provide a nip therebetween. The ejection roller pair ejects the sheet. The sheet detection portion is disposed along the sheet conveyance path and located upstream of the at least one ejection roller pair in a sheet conveyance direction. The sheet detection portion detects the sheet being ejected. The sheet detection portion includes an actuator and a sensor. The actuator is disposed along the sheet conveyance path and extends from a location upstream of the at least one ejection roller pair in the sheet conveyance direction to the at least one ejection roller pair. The actuator moves by contact with the sheet passing along the sheet conveyance path. The sensor detects the actuator. The actuator moves between a detectable position where the actuator is detectable by the sensor and an undetectable position where the actuator is not detectable by the sensor. The actuator has a sheet guide portion. The sheet guide portion extends along the sheet conveyance direction. The sheet guide portion moves, in a direction transverse to the sheet conveyance direction such that the actuator moves to the detectable position, by contact with the sheet passing along the sheet conveyance path and guides the sheet in the sheet conveyance direction.

An image forming apparatus according to the present disclosure includes the above-described sheet ejecting device and an image forming section. The image forming section forms an image on a sheet. The sheet ejecting device ejects the sheet.

DETAILED DESCRIPTION

Figure 1A:
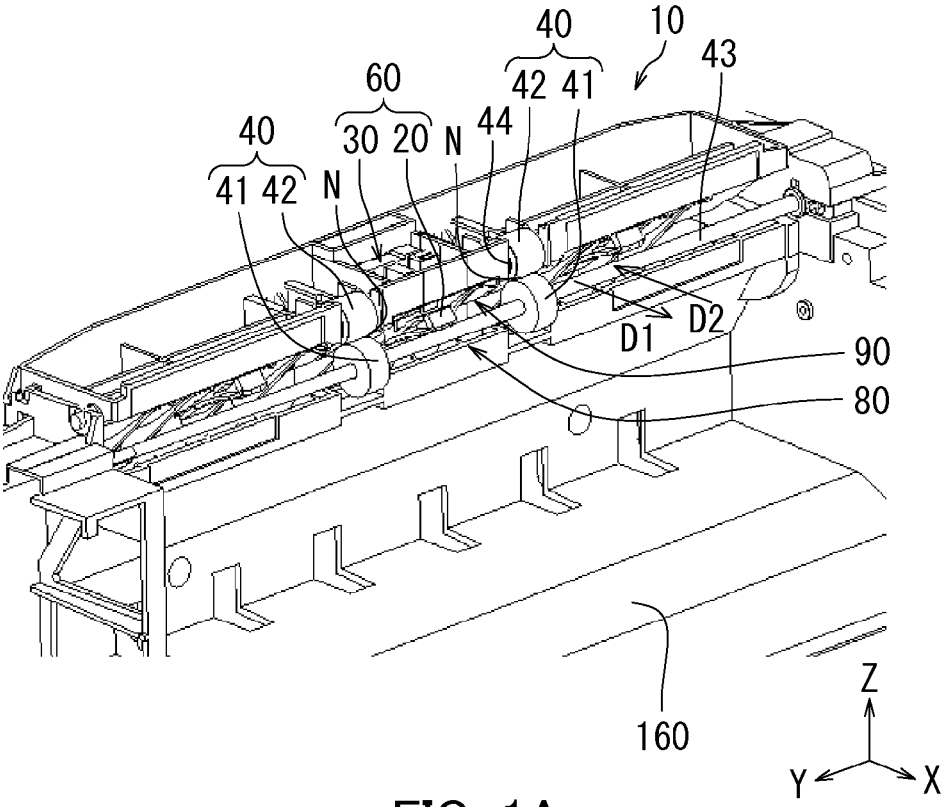
FIG. 1A is a perspective view of a sheet ejecting device according to an embodiment of the present disclosure.

Hereinafter, embodiments of the present disclosure will be described with reference to the accompanying drawings. It should be noted that in the drawings, elements that are the same or substantially equivalent are labelled using the same reference signs and explanation thereof is not repeated.

Figure 1B:
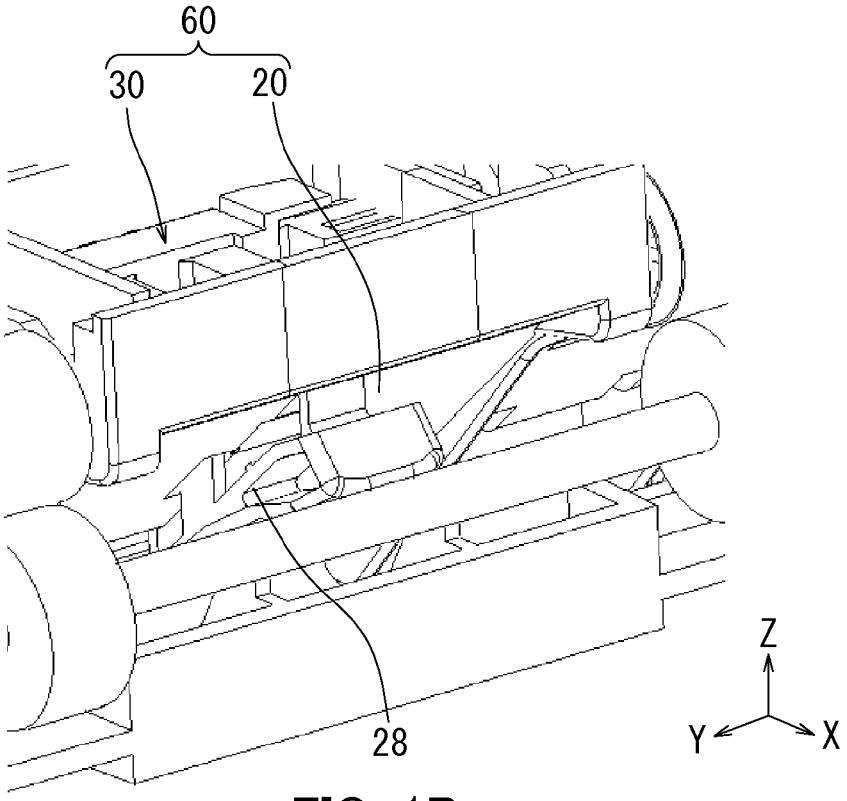
FIG. 1B is an enlarged view of a central part of FIG. 1A.

A sheet ejecting device 10 according to an embodiment of the present disclosure will be described with reference to FIGS. 1A and 1B. FIG. 1A is a perspective view of the sheet ejecting device 10 according to the embodiment of the present disclosure. FIG. 1B is an enlarged view of a central part of FIG. 1A. An X axis and a Y axis are perpendicular to each other and parallel to a horizontal plane. A Z axis is parallel to a vertical direction.

The sheet ejecting device 10 includes a sheet conveyance path 80, an exit port 90, two ejection roller pairs 40, and a sheet detection portion 60. The sheet ejecting device 10 is for example mounted in an image forming apparatus. The sheet conveyance path 80 extends to the ejection roller pairs 40. The exit port 90 is elongated in a Y axis direction.

The ejection roller pairs 40 each include a drive roller (rotatory body) 41 and a driven roller (rotatory body) 42. The ejection roller pairs 40 are provided at the exit port 90. The two drive rollers 41 are arranged around a drive roller shaft 43 with a space therebetween. Each drive roller 41 is rotatable integrally with the drive roller shaft 43. The drive roller shaft 43 is elongated in the Y axis direction. The two driven rollers 42 are arranged around a driven roller shaft 44. Each of the two driven rollers 42 is located opposite to the corresponding drive roller 41. Each drive roller 41 and the corresponding driven roller 42 provide a nip therebetween. A peripheral surface of each driven roller 42 is pressed against a peripheral surface of the corresponding drive roller 41. A sheet passes between the peripheral surfaces of the driven rollers 42 and the peripheral surfaces of the drive rollers 41. Each drive roller 41 rotates with rotation of the drive roller shaft 43 that is driven by actuation of a drive motor. Each driven roller 42 rotates in response to the rotation of the corresponding drive roller 41. Using the ejection roller pairs 40, the sheet ejecting device 10 ejects, in a direction D1 from the exit port 90 toward an exit tray 160, a sheet conveyed thereto along the sheet conveyance path 80. For duplex printing, each drive roller 41 rotates in a reverse direction to convey a sheet in a direction D2 for switching back once a part of the sheet is ejected.

The sheet detection portion 60 has an actuator 20 and a sensor 30. The sheet detection portion 60 detects a sheet being ejected. The sheet detection portion 60 is provided at the exit port 90. The sheet detection portion 60 is disposed along the sheet conveyance path 80 and located upstream of the ejection roller pairs 40 in the sheet conveyance direction D1. The sheet detection portion 60 is provided near a central part of the sheet ejecting device 10. The ejection roller pairs 40 are provided at opposite sides of the sheet detection portion 60. The actuator 20 extends from a location upstream of the ejection roller pairs 40 in the sheet conveyance direction D1 to the ejection roller pairs 40. The actuator is disposed between the nips that are adjacent to one another in a direction parallel to the drive roller shaft 43 and the driven roller shaft 44.

Figure 2:
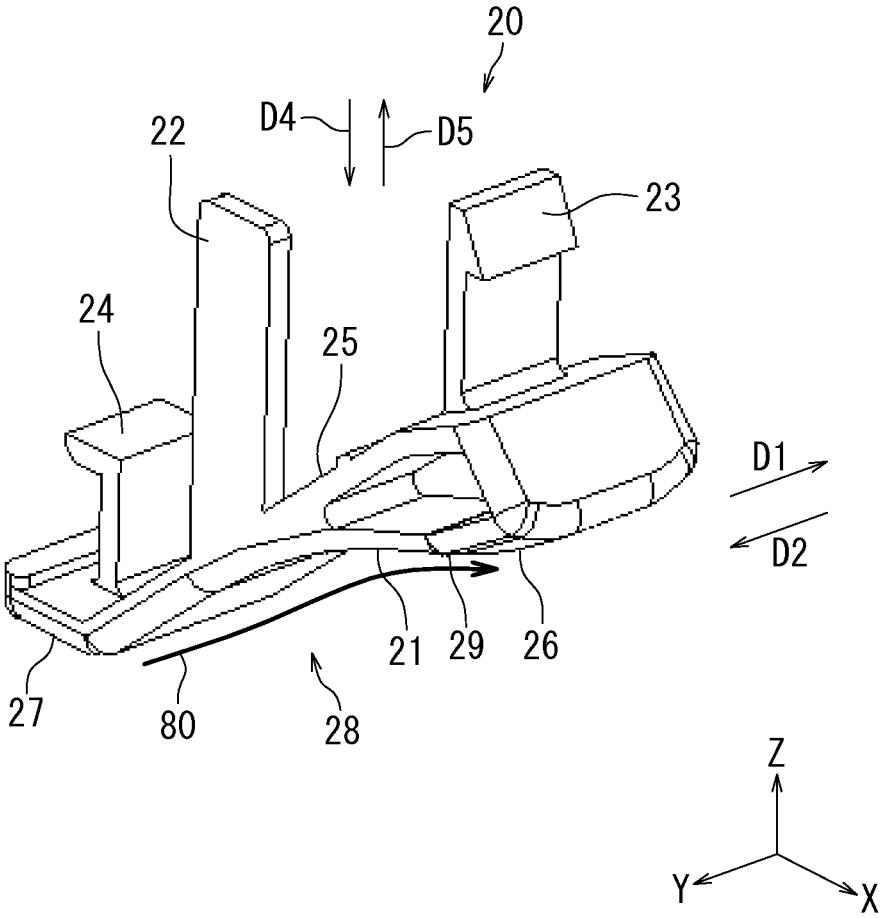
FIG. 2 is a perspective view of an actuator in a sheet detection portion of the sheet ejecting device according to the embodiment of the present disclosure.

The actuator 20 of the sheet ejecting device 10 according to the present disclosure will be described with reference to FIG. 2. FIG. 2 is a perspective view of the actuator 20 of the sheet ejecting device 10.

The actuator 20 has a sheet guide portion 28, a pressing portion 26, an engagement portion 23, an engagement portion 24, and a rear end portion 27. The sheet guide portion 28 has a guide surface 21, a back surface 25, and a detection plate 22. The back surface 25 is located at an opposite side of the guide surface 21. The pressing portion 26 is located downstream of the sheet guide portion 28 in the sheet conveyance direction (ejection direction) D1.

The sheet guide portion 28 extends at an angle upwardly and downstream in the sheet conveyance direction D1. The guide surface 21 has an upward arc shape (an arc shape with a circle center thereunder). The guide surface 21 is in a position that can be in contact with a sheet. The sheet is conveyed while in contact with the guide surface 21. Thus, the sheet can be guided to the pressing portion 26. The pressing portion 26 has a downward arc shape (an arc shape with a circle center thereabove). The shape facilitates the sheet to be conveyed smoothly when the sheet is ejected in the ejection direction D1 or when the sheet is conveyed in the direction D2 for switching back. The pressing portion 26 has a pressing face 29. The pressing face 29 presses a top surface of the sheet that is conveyed to the ejection roller pairs 40 and ejected from the ejection roller pairs 40 to curve the sheet.

The detection plate 22 is a flat plate. The detection plate 22 projects upward from the back surface 25. The engagement portion 23 is provided on the pressing portion 26. The engagement portion 24 is provided on the rear end portion 27. The engagement portion 23 and the engagement portion 24 extend upward and have a hooked shape. The actuator 20 is attached to a housing thereof provided in the sheet ejecting device 10 with the engagement portion 23 and the engagement portion 24 engaged with the housing. The housing in the sheet ejecting device 10 has a guide groove (not shown) extending in a vertical direction. The actuator 20 is movable along a direction transverse to the sheet conveyance direction. More specifically, the actuator 20 can move in a direction D4 and in a direction D5. In the present embodiment, the direction D4 is a downward direction, and the direction D5 is an upward direction. In the present embodiment, the actuator 20 is movable in the upward and downward directions along the guide groove.

Figure 3A:
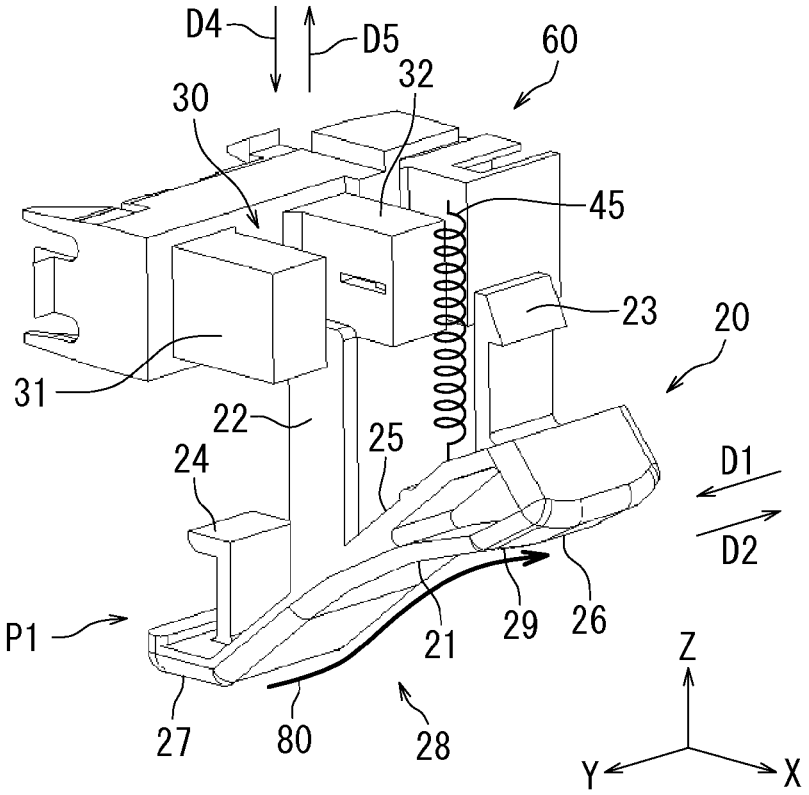
FIGS. 3A and 3B are perspective views of the sheet detection portion and an urging member.
Figure 3B:
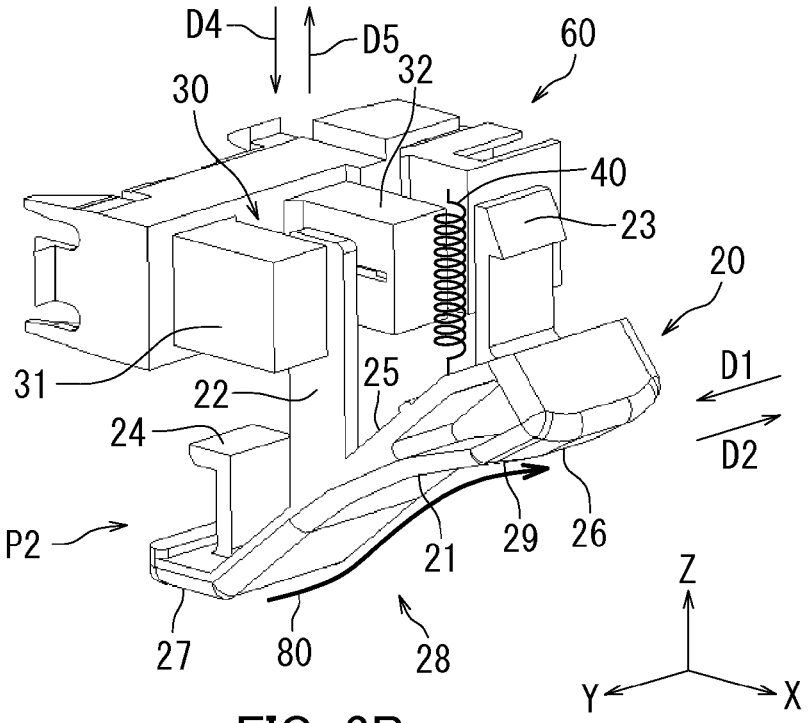

Sheet detection that is performed in the sheet ejecting device 10 according to the present disclosure will be described with reference to FIGS. 3A and 3B. FIGS. 3A and 3B are perspective views of the sheet detection portion 60 and an urging member 45.

The sensor 30 is for example a photointerrupter sensor. The sensor 30 has a light emitter 31 and a light receiver 32. The light emitter 31 emits light toward the light receiver 32. The light receiver 32 receives the light emitted from the light emitter 31. The sensor 30 detects the actuator 20. The sensor 30 determines the absence of a sheet based on the light receiver 32 receiving light emitted from the light emitter 31.

The sheet ejecting device 10 further includes the urging member 45. The urging member 45 is for example a spring. One end of the urging member 45 is connected with the actuator 20, and the other end is connected with the housing in the sheet ejecting device 10. The urging member 45 urges the sheet guide portion 28 of the actuator 20 to project toward the sheet conveyance path 80 into a projection position. In the present embodiment, the urging member 45 urges the sheet guide portion 28 of the actuator 20 downward.

The sheet is conveyed with a leading edge thereof in contact with the actuator 20. Once the sheet reaches the actuator 20, the actuator 20 is pushed up by the sheet to move upward (that is, in the direction D5) (hereinafter, referred to as a sheet present state). Once a trailing edge of the sheet finishes passing the actuator 20, the actuator 20 moves downward (that is, in the direction D4) because of the downward urging by the urging member 45 (hereinafter, referred to as a sheet absent state). The actuator 20 moves upward and downward depending on the presence and absence of a sheet.

During the sheet absent state, that is, while no sheet is being conveyed in the sheet ejecting device 10, the actuator 20 is in a lower position as illustrated in FIG. 3A because of the downward urging by the urging member 45. In the present specification, a position the actuator 20 is at when the actuator 20 is in a state illustrated in FIG. 3A may be referred to as an undetectable position P1. The undetectable position P1 refers to a position of the actuator 20 where the actuator 20 is undetectable by the sensor 30. When the actuator 20 is at the undetectable position P1, light emitted from the light emitter 31 is not blocked by the detection plate 22, and therefore the light receiver 32 receives the light. As a result, the sensor 30 can determine the absence of a sheet under the actuator 20.

On the other hand, during the sheet present state, that is, while a sheet is being conveyed in the sheet ejecting device 10, the actuator 20 is pushed up by the sheet, and therefore the actuator 20 is in an upper position as illustrated in FIG. 3B. In the present specification, a position the actuator 20 is at when the actuator 20 is in a state illustrated in FIG. 3B may be referred to as a detectable position P2. The detectable position P2 refers to a position of the actuator 20 where the actuator 20 is detectable by the sensor 30. When the actuator 20 is at the detectable position P2, the light receiver 32 does not receive light since the light emitted from the light emitter 31 is blocked by the detection plate 22. As a result, the sensor 30 can determine the presence of the sheet under the actuator 20.

As described with reference to FIGS. 3A and 3B, the sensor 30 detects the presence or absence of a sheet by sensing whether or not the detection plate 22 is blocking light emitted from the light emitter 31 toward the light receiver 32, that is, by sensing the upward or downward movement of the actuator 20. The state transitions from the sheet absent state to the sheet present state, and then back to the sheet absent state every time a sheet passes the actuator 20. More specifically, the position of the actuator 20 changes from the undetectable position P1 to the detectable position P2 as the actuator 20 moves in the direction D5. The position of the actuator 20 changes from the detectable position P2 to the undetectable position P1 as the actuator 20 moves in the direction D4. On the other hand, in case of a jam in the sheet ejecting device 10, the sheet present state, that is, the state in which the actuator 20 is at the detectable position P2 lasts for a long time. The sensor 30 can therefore detect the presence or absence of a jam in the sheet ejecting device 10.

Figure 4A:
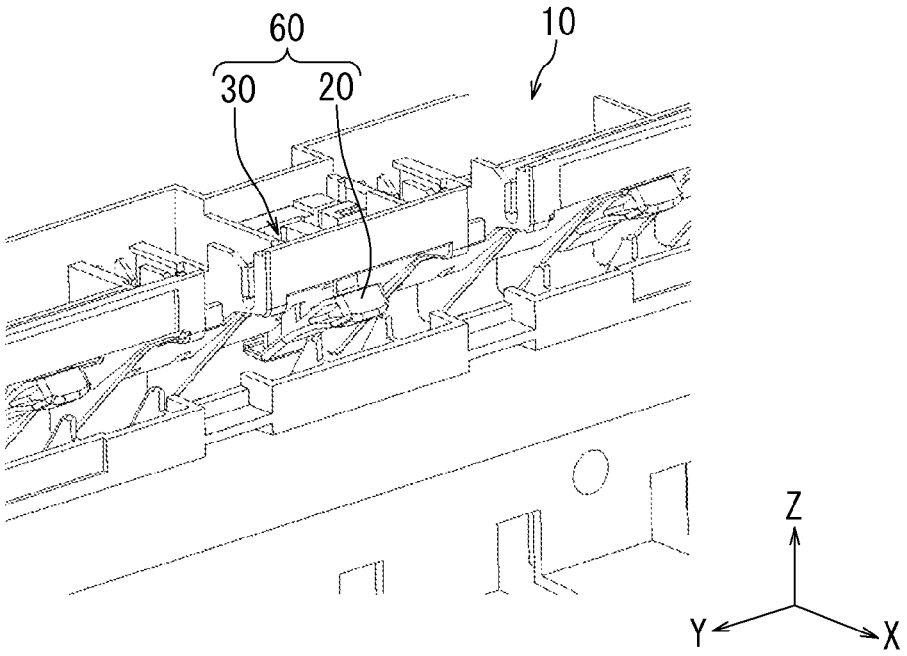
FIGS. 4A and 4B are perspective views of the sheet ejecting device according to the embodiment of the present disclosure.
Figure 4B:
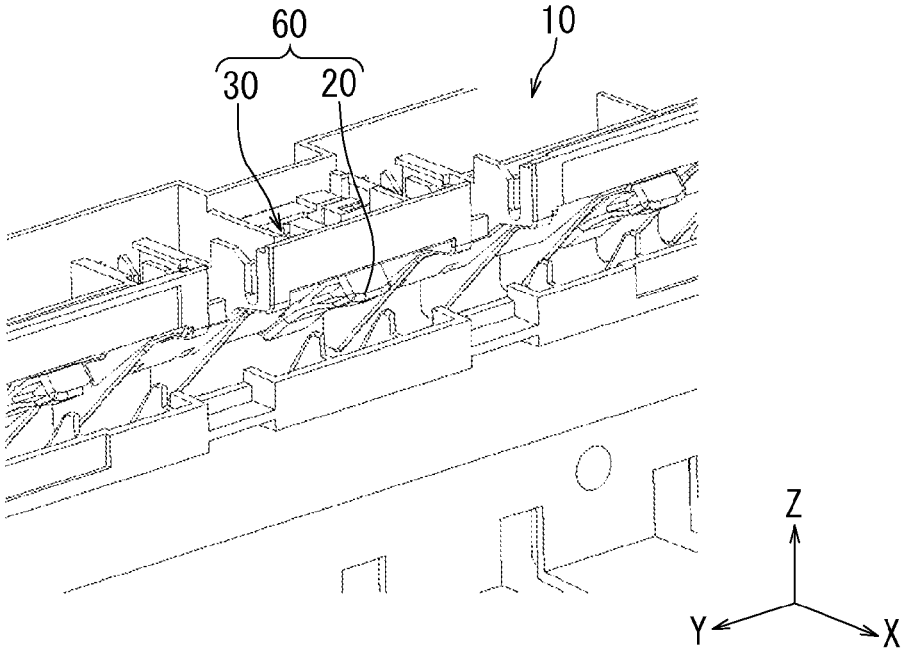

Sheet detection in the sheet ejecting device 10 according to the present disclosure will be described with reference to FIGS. 4A and 4B. FIGS. 4A and 4B are perspective views of the sheet ejecting device 10 according to the embodiment of the present disclosure. The ejection roller pairs 40, the drive roller shaft 43, the driven roller shaft 44, and the urging member 45 are not shown in FIGS. 4A and 4B. During the sheet absent state, the actuator 20 is urged downward by the urging member 45 and is in a state illustrated in FIG. 4A. On the other hand, during the sheet present state, the actuator 20 is pushed up by a sheet and is in a state illustrated in FIG. 4B.

As described with reference to FIGS. 1A to 4B, the actuator 20 in the sheet ejecting device 10 has the guide surface 21 having an arc shape, and the sensor 30 detects the presence or absence of a sheet according to the upward or downward movement of the actuator 20. According to the configuration, the load of the conveyance that is caused during the sheet detection can be reduced, preventing occurrence of skew.

The sensor 30 detects the presence or absence of a sheet by detecting the upward or downward movement of the actuator 20. According to the configuration, the load of the sheet conveyance can be reduced more compared to a configuration of an actuator that detects the presence or absence of a sheet by its turning. Furthermore, the presence or absence of a sheet can be detected with a small amount of movement of the actuator 20, reducing the possibility of misdetection of the presence or absence of a sheet. Besides, the presence or absence of a sheet can be detected with simple configuration.

Since the sheet ejecting device 10 further includes the urging member 45 that urges the actuator 20 downward, the actuator 20 can be kept in the lower position in a stable manner in the absence of a sheet. The sensor 30 can thus detect the presence or absence of a sheet.

The actuator 20 is disposed such that the guide surface 21 extends at an angle upwardly and downstream in the sheet ejection direction D1. According to such a configuration, the load of the conveyance that is caused during the sheet detection can be reduced.

Figure 5:
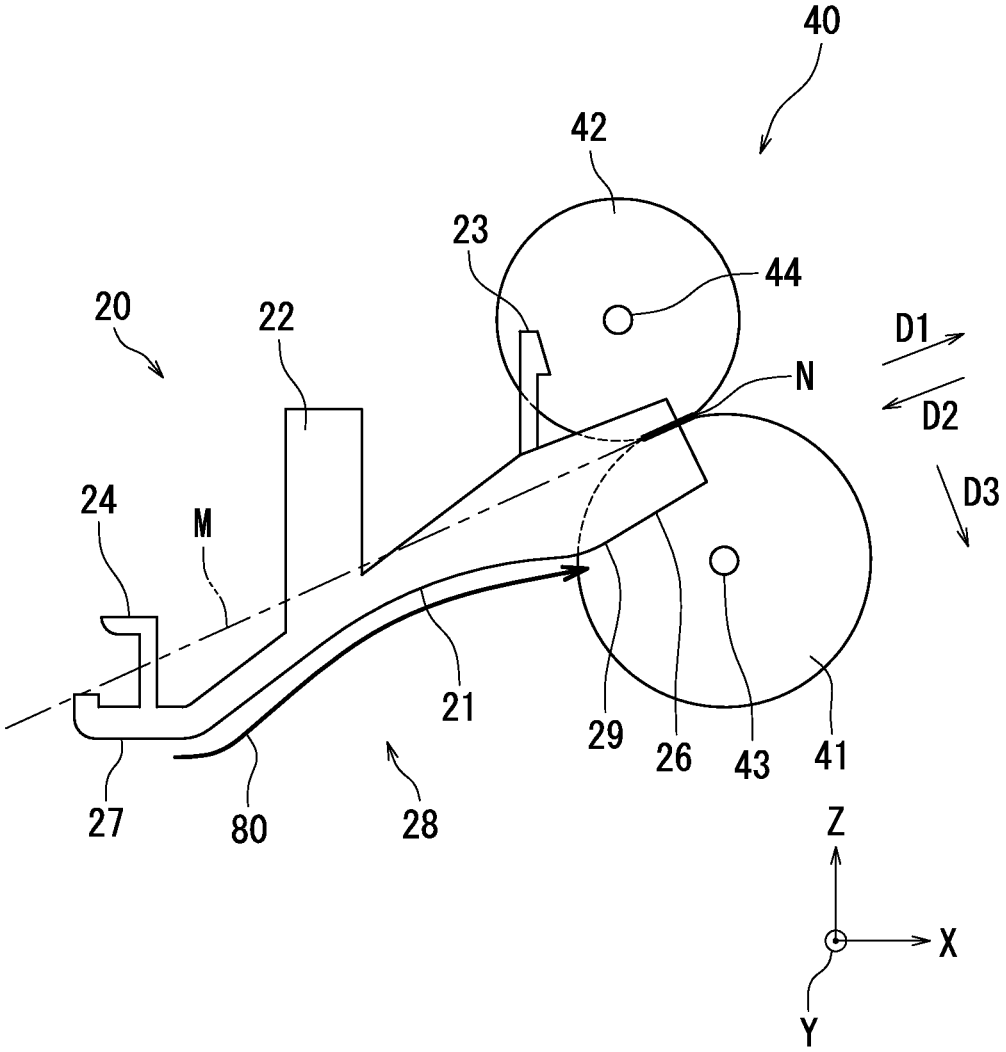
FIG. 5 is a schematic illustration of the actuator and ejection roller pairs in the sheet ejecting device according to the embodiment of the present disclosure.

The arrangement of the actuator 20 in the sheet ejecting device 10 according to the present disclosure will be described with reference to FIG. 5. FIG. 5 is a schematic illustration showing the actuator 20 and the ejection roller pairs 40 in the sheet ejecting device 10 according to the embodiment of the present disclosure. A dashed and double dotted line represents imaginary lines M each defined by an extension of a nip N.

When the actuator 20 is at the undetectable position P1, the pressing face 29 as viewed in the direction parallel to the drive roller shaft 43 and the driven roller shaft 44 is located close to the rollers of the ejection roller pairs 40 at a side of the undetectable position P1 based on the nips N (close to the drive rollers 41 in the present embodiment) rather than close to the other rollers. In other words, the actuator 20 is disposed such that the pressing face 29 is at a location lower than the nips N between the respective ejection roller pairs 40 (at a location nearer the position of the sheet conveyance path 80). That is, the actuator 20 is disposed such that the pressing face 29 is at a location nearer the position of the sheet conveyance path 80 than the imaginary lines M as viewed in the direction parallel to the drive roller shaft 43 and the driven roller shaft 44. Since the actuator 20 is disposed such that the pressing face 29 is located close to the rollers of the ejection roller pairs 40 at a side of the undetectable position P1 based on the nips N rather than close to the other rollers when at the undetectable position P1, the actuator 20 presses a top surface of a sheet in a direction (direction D3) perpendicular to the sheet conveyance direction to curve the sheet while the sheet is being conveyed, that is, while the sheet is present under the actuator 20. That is, the actuator 20 is capable of tensioning (corrugating) the sheet. Thus, the sheet is prevented from being conveyed while in a curled state. Preferably, the level of the pressing face 29 is substantially the same as the level of the nips N when the actuator 20 moves upward by contact with a sheet. Such a configuration further ensures that the sheet is corrugated.

Figure 6:
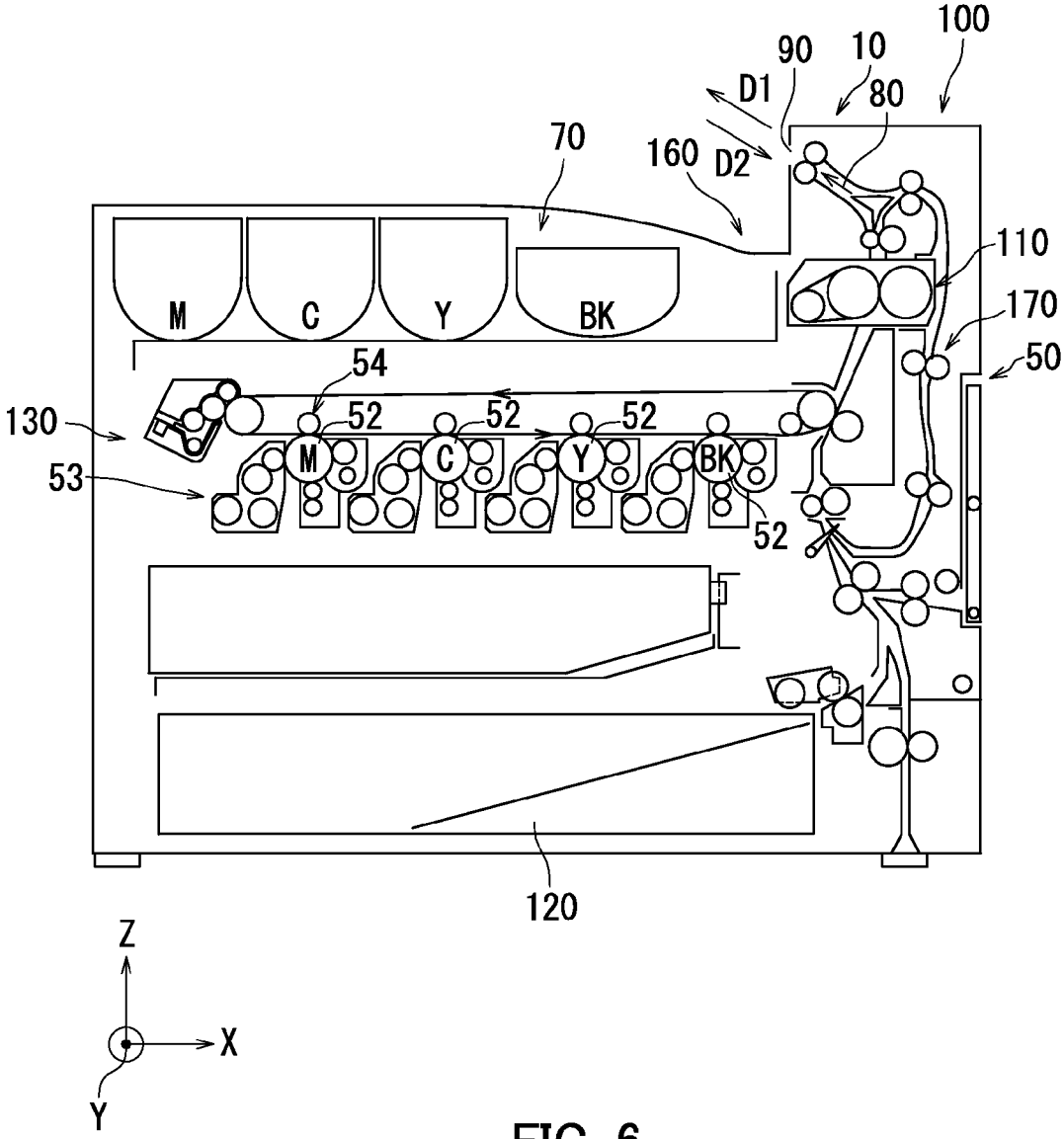
FIG. 6 is a cross sectional view illustrating general configuration of an image forming apparatus according to an embodiment of the present disclosure.

An image forming apparatus 100 according to an embodiment of the present disclosure will be described with reference to FIG. 6. FIG. 6 is a cross sectional view illustrating general configuration of the image forming apparatus 100 according to the embodiment of the present disclosure.

The image forming apparatus 100 includes the sheet ejecting device 10 and an image forming section 50. The image forming section 50 has a fixing device 110, a sheet feed cassette 120, an imaging section 130, a toner replenishment device 70, and a sheet conveyance section 170. The image forming apparatus 100 is for example a printer. The image forming section 50 forms an image on a sheet. The sheet ejecting device 10 ejects a sheet on which an image has been formed.

The sheet feed cassette 120 stores therein printing sheets. For printing, a sheet from the sheet feed cassette 120 is conveyed by the sheet conveyance section 170 along the sheet conveyance path 80 of the sheet ejecting device 10 so as to be ejected from the exit port 90 after passing through the imaging section 130 and the fixing device 110.

The imaging section 130 forms a toner image on a sheet. The imaging section 130 includes photosensitive members 52, developing devices 53, and transfer devices 54.

An electrostatic latent image is formed on each photosensitive member 52 for example with laser based on an electronic signal representing an image of an original document. Each developing device 53 has a developing roller. Each developing roller supplies a toner to the corresponding photosensitive member 52 for development of the electrostatic latent image to form a toner image on the photosensitive member 52. The toner replenishment device 70 replenishes each developing device 53 with a toner.

Each transfer device 54 transfers the toner image formed on the corresponding photosensitive member 52 onto the sheet.

The fixing device 110 applies heat and pressure to the sheet using a fixing member and a pressure member to melt and fix, on the sheet, unfixed toner images formed in the imaging section 130.

Lastly, the sheet on which an image has been formed by the image forming section 50 is ejected in the direction D1 by the sheet ejecting device 10 toward the exit tray 160. For duplex printing, the sheet is conveyed in the direction D2 for switching back once a part of the sheet is ejected.

So far, the embodiments of the present disclosure have been described with reference to the accompanying drawings (FIGS. 1A-6). However, the present disclosure is not limited to the above-described embodiments and can be practiced in various ways within the scope not departing from the essence of the present disclosure (e.g., as described below in sections (1) and (2)). The drawings are intended to emphasize the components in a schematic manner to assist with understanding. The thickness, the length, the number, and so on of the components illustrated are not true to scale for diagrammatic purposes. The material, the shape, the dimensions, and so on of each component shown in the above-described embodiments are only exemplary and do not represent any particular limitations. Various alternations can be made thereto within the scope not substantially departing from the effect of the present disclosure.

(1) The sheet ejecting device 10 according to the present embodiment includes the urging member 45. Alternatively, the sheet ejecting device 10 may not include the urging member 45. For example, the actuator 20 may be pushed up by a sheet passing thereunder and then returned downward only by the weight of the actuator 20 itself.

(2) In the present embodiment, description is provided using a printer as an example of the present disclosure. However, the present disclosure may be applied to a different type of image forming apparatus other than the printer (e.g., a multifunction peripheral).

What is claimed is:

1. A sheet ejecting device configured to eject a sheet conveyed thereto, comprising:

a sheet conveyance path along which the sheet is conveyed;

an exit port which is located at a downstream end of the sheet conveyance path in a sheet conveyance direction and from which the sheet is ejected;

at least one ejection roller pair configured to eject the sheet, the at least one ejection roller pair being disposed at the exit port and including a drive roller and a driven roller providing a nip therebetween; and a sheet detection portion configured to detect the sheet being ejected, the sheet detection portion being disposed along the sheet conveyance path and located upstream of the at least one ejection roller pair in the sheet conveyance direction, wherein the sheet detection portion includes:

an actuator configured to move by contact with the sheet passing along the sheet conveyance path, the actuator being disposed along the sheet conveyance path and extending from a location upstream of the at least one ejection roller pair in the sheet conveyance direction to the at least one ejection roller pair; and a sensor configured to detect the actuator, the actuator moves between a detectable position where the actuator is detectable by the sensor and an undetectable position where the actuator is not detectable by the sensor, the actuator has a sheet guide portion extending along the sheet conveyance direction, the sheet guide portion is configured to move, in a direction transverse to the sheet conveyance direction such that the actuator moves to the detectable position, by contact with the sheet passing along the sheet conveyance path and guide the sheet in the sheet conveyance direction, the at least one ejection roller pair is a plurality of ejection roller pairs, the drive rollers of the plurality of ejection roller pairs are disposed around a drive roller shaft with a space therebetween, the driven rollers of the plurality of ejection roller pairs are disposed around a driven roller shaft such that each of the driven rollers is located opposite to the corresponding drive roller and provides the nip therebetween, the actuator is disposed between two of the nips that are adjacent to one another in a direction parallel to the drive roller shaft and the driven roller shaft, the actuator further has a pressing face at a downstream end thereof in the sheet conveyance direction, the pressing face being configured to press a top surface of the sheet being conveyed by the ejection roller pairs and ejected from the ejection roller pairs to curve the sheet, and the pressing face is located lower than the nips as viewed in the direction parallel to the drive roller shaft and the driven roller shaft when the actuator is at the undetectable position.

2. The sheet ejecting device according to claim 1, wherein the sheet guide portion includes:

a guide surface configured to guide the sheet;

a back surface at an opposite side of the guide surface; and a detection plate projecting from the back surface, and the sensor detects the detection plate.

3. The sheet ejecting device according to claim 1, further comprising an urging member configured to urge the sheet guide portion to project toward the sheet conveyance path into a projection position.

4. The sheet ejecting device according to claim 1, wherein the sensor has:

a light emitter configured to emit light; and a light receiver configured to receive the light emitted from the light emitter, and the sensor determines absence of a sheet when the light receiver receives light.

5. The sheet ejecting device according to claim 1, wherein the actuator is configured to move in upward and downward directions.

6. An image forming apparatus comprising:

the sheet ejecting device according to claim 1; and an image forming section configured to form an image on the sheet, wherein the sheet ejecting device is configured to eject or switch back the sheet.

* * * * *